US005915297A

United States Patent [19]

Lehtovirta et al.

[11] Patent Number: 5,915,297

[45] Date of Patent: Jun. 29, 1999

[54] APPARATUS FOR PREVENTING VIBRATIONS OF A ROLL SET

[75] Inventors: Esa Lehtovirta; Jorma Köliö, both of Jyväskylä; Markku Salo, Muurame; Kari Luostarinen, Jyväskylä, all of Finland

[73] Assignee: Valmet Corporation, Helsinki, Finland

[21] Appl. No.: 08/988,122

[22] Filed: Dec. 10, 1997

Related U.S. Application Data

[62] Division of application No. 08/570,266, Dec. 11, 1995, Pat. No. 5,768,985.

[51] Int. Cl.[6] ..... B30B 15/34; B30B 3/04; D21G 1/02

[52] U.S. Cl. ..... 100/336; 100/155 R; 100/176

[58] Field of Search ..... 100/43, 155 R, 100/176, 327, 336; 492/15, 20, 46, 60

[56] References Cited

U.S. PATENT DOCUMENTS 3,111,189 11/1963 Murray .
3,512,475 5/1970 Justus et al. ..... 492/20
3,726,338 4/1973 Sorenson .
4,471,515 9/1984 Takenaka et al. .
4,670,102 6/1987 Maurer et al. ..... 100/176
4,910,842 3/1990 Brendel ..... 100/176
5,024,150 6/1991 Brendel et al. .
5,081,759 1/1992 Schiel .
5,244,448 9/1993 Niskanen et al. .

*Primary Examiner*—Stephen F. Gerrity
*Attorney, Agent, or Firm*—Cohen, Pontani, Lieberman & Pavane

[57] ABSTRACT

An apparatus for reducing or preventing vibrations of a roll set of a paper making apparatus, wherein the roll set comprises at least two rolls of which at least one is a soft roll coated with a compressible coating and comprising a temperature control system. The natural vibrational frequency of the roll set is changed during the operation of the apparatus by changing the temperature of the coating of the at least one soft roll. The changing of the natural frequency prevents resonance on a natural frequency of the roll set.

18 Claims, 4 Drawing Sheets

APPARATUS FOR PREVENTING VIBRATIONS OF A ROLL SET

This is a division of application Ser. No. 08/570,266 filed Dec. 11, 1995, now U.S. Pat. No. 5,768,985.

FIELD OF THE INVENTION

The present invention relates to an apparatus for reducing or preventing vibrations of roll sets of paper making machinery comprising at least one roll coated with a soft coating and having a steel core.

BACKGROUND OF THE INVENTION

In the paper making industry, different kinds of roll sets are used for different purposes. A roll set comprises at least two rolls which form a nip through which a paper or a cardboard web is guided. Roll sets comprising at least one soft roll are used mainly in calenders and size presses. A size press is used for impregnating the paper web with glue or for coating the web with a pigment. A modern size press comprises two rolls coated with a soft rubber coating and means for applying coating mix to the surfaces of the rolls. The web travels through the nip formed by the rolls, and the coating is formed on both sides of the web simultaneously when the rolls covered with the coating mix are pressed against the web.

In soft calenders, a roll set comprises a soft roll covered with a polymer material and a backing roll made of steel, and the calender typically has two roll sets for calendering both sides of the web. In some applications, a roll set comprising three rolls may be used. This arrangement consists of two soft rolls and a backing roll. The backing roll forms a nip with both of the soft rolls, and the web passes successively through both nips and is thereby calendered twice. In a supercalender, a roll set comprises even more rolls, and a soft roll is always placed between two hard backing rolls. Since polymer materials presently available do not endure two or more nips on a same roll, the soft coating of the supercalender rolls is made of cotton or paper discs which are tightly pressed on the core of the roll.

One relevantly frequent problem with rotating roll sets is oscillation of the nip formed by rolls. Oscillation of a nip formed of two or more hard steel rolls can be avoided to a large extent by balancing and proper dimensioning, but when the web speeds of paper making machinery have increased, it has been noted that a nip formed by two soft rolls or by a soft roll and two or more hard rolls tends to start to vibrate at certain web speeds. The reason for this has not been known so far. These oscillations could be easily avoided by changing the web speed of the machine so that the vibration does not coincide with the natural frequency of the roll set. However, size presses and soft calenders, in which soft rolls are most commonly used, are almost without exception on-machine apparatuses. It is obvious that the paper makers want to run their machinery at a speed that results in the best quality and productivity. For example, a head box usually works best at a certain speed. This speed depends on the thickness of the web and other variables and is different for each kind of paper. For this reason it is not acceptable to change the speed of the paper machine to eliminate vibration of a size press or a calender. Speed changes also increase risk of web breaks which have a strong influence on the productivity of the machine. Changing and controlling the speed of an entire manufacturing line is very difficult, and it is preferred to run the machine on a steady speed.

The tendency of the machine to vibrate can be diminished by using rolls which have a thinner coating and a thicker core. In practice this solution is not very good since a thicker core leads to heavier rolls. The thickness of the coating can be decreased only to a certain extent since rolls have to be grinded at regular intervals due to wear and deformation of the coating. Furthermore, size presses and calenders are designed to use rolls having a certain kind of coating and use of different kinds of rolls in existing apparatuses can be difficult.

SUMMARY OF THE INVENTION

According to the present invention, the natural frequency of a roll set in a calender or a size press is varied during the operation of the apparatus by changing the temperature of the coating of at least one soft roll in the set.

According to the other aspects of the present invention, the temperature of the coating is changed by cooling the soft roll with circulating water. Furthermore, the cooling is initiated when increasing vibrations in the nip of the rolls is detected.

The term "soft roll" is used to refer generally to rolls having a steel core and a coating of compressible synthetic or natural rubber or synthetic polymer material or other material which is softer and more easily deformed than steel.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
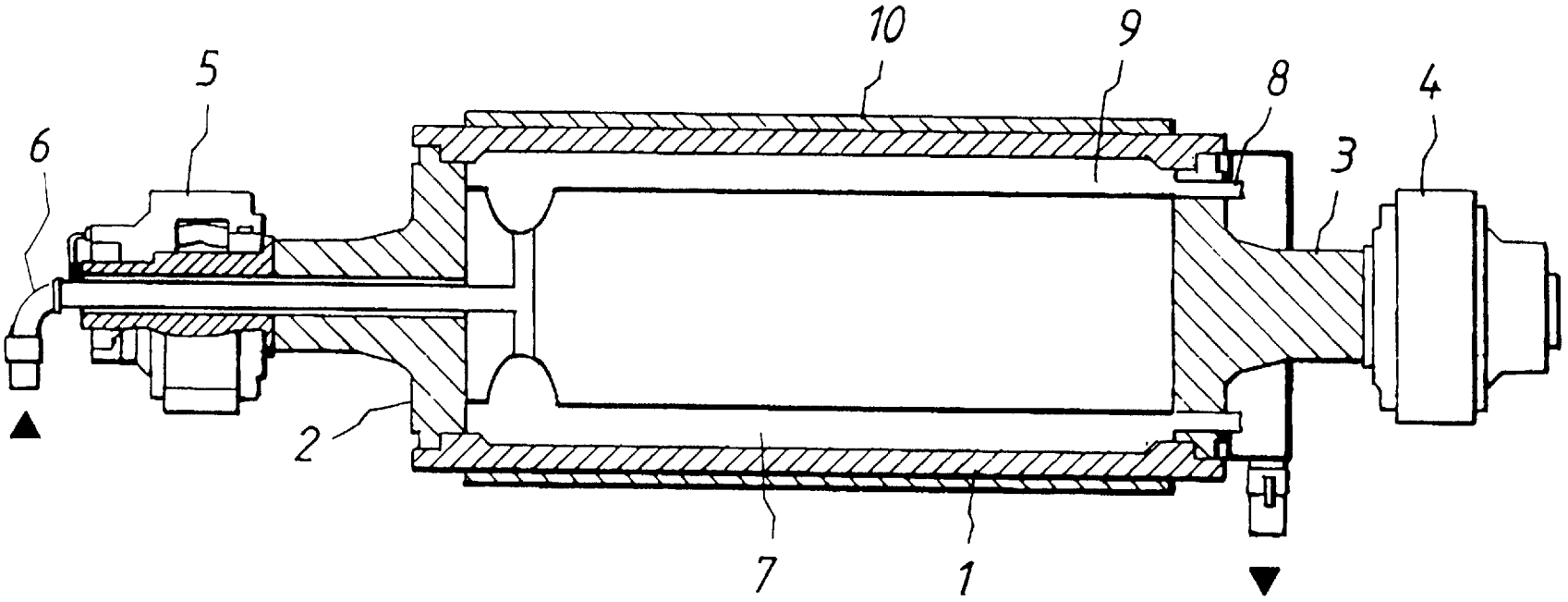
FIG. 1 is a schematic sectional view of a typical water cooled soft roll.

An object of the present invention is to reduce the vibrations of roll nips which are caused by heating of materials and structures. Heat can directly effect excitations or the dynamic properties of the system. Heating of coating materials of soft rolls is such a variable. For example, rolls of size presses are coated with rubber, which is a viscoelastic material. The mechanical properties of the material depend on its temperature. For example, the elastic modulus of rubber materials may decrease over 50% when the temperature rises from 20° C. to 65° C. The natural frequencies of the nip vibration are thus highly dependent upon the properties of the rubber. The above mentioned change in elastic modulus changes the natural frequency of the roll set of one size press manufactured by the applicant from 64 Hz to 53 Hz. The amplitude of the change is different for different kinds of roll sets, but the changing properties of the coating clearly effect the natural frequencies of roll sets in this manner.

One particular feature that amplifies the vibrations relates to the internal damping of rubber. Deformations in rubber return quite slowly and since the time of one revolution in modern fast machines is about 0.3 s, the pattern caused by the opposing roll in the nip does not return during one revolution. This pattern is a wave-like formation which rises from the surface of the roll after the nip, sinks in the nip and rises after the nip. The rising part of the wave leaving the nip does not level down during one revolution and hits the nip during the next revolution. This causes a periodical excitation on the roll set. If the excitation frequency is close to the natural frequency of the roll set, the vibration of the set increases, first gradually. However, if the web speed remains the same for a longer period, the amplitude begins to rise and leads quite rapidly to excessive vibration or a web break and the machine has to be stopped. The transmission and electrical motors of the apparatus as well as deformations in the web may also excite vibration of the roll set.

Since the physical properties of the soft coating vary according to its temperature, the natural frequency of the roll set changes during the operation of the machine because of heating of the coating. In a normal running situation, the machine operates at the same speed for a long period of time if web breaks do not occur and excessive vibration does not arise. During the running period, the natural frequency of the roll set changes, and when the natural frequency and the frequency of the excitation are sufficiently close to one another the system settles on a resonant frequency and the vibration amplitude begins to rise. Thus the apparatus seeks a steady state of operation wherein the natural frequency of the roll set and the frequency of the excitation lead to resonance.

According to the present invention the natural frequency of a roll set is controlled by an adjustable temperature controlling system.

By changing the natural frequency of the roll set the increasing of vibration is prevented since the natural frequency of the roll set is allowed to remain at a resonant frequency. Thus the system does not find a steady state wherein resonance occurs and the amplitude of the vibration is increased. In principle, the effect of a temperature change is same as the effect of a change in running speed—the frequencies of the excitements and the natural frequencies are prevented from approaching one another for a substantial period of time. By changing the natural frequency of the roll set, for example by cooling one or more of the soft rolls, the natural frequency of the roll set passes the frequency of the excitement, and no resonance occurs. Consequently, it is not necessary to control the vibrations by changing the operation speed or by using only certain running speeds at which vibrations are minimized. The choice of the running speed of a paper machine depends on facts relating to paper quality and rentability of the machine. Obviously, it is desirable to run the paper machine at a speed resulting in best quality and rentability, and speed changes are preferably avoided. For this reason, paper manufacturers do not purchase machinery which does not allow them to choose the running speed freely within the designed speed limits of the machine. If the vibrations of the machine are controlled according to the present invention, the paper quality can be maintained uniform, the soft coating of rolls lasts longer, and the frequency of breaks diminishes.

FIG. 1 shows a water cooled soft roll. The roll comprises a hollow core 1 and two ends 2, 3 attached to the ends of the core 1 and having axles extending outwards from the ends of the core 1. The axles are mounted on bearings 4, 5. The coolant, which is usually water, is introduced into the roll through a pipe 6 arranged within one end 2 of the roll. Within the core 1 is a inner core 7 attached to the ends 2, 3. The inner core 7 has an outer diameter that is smaller than the inner diameter of the core 1. The core 1 and the inner core 7 form a passage 9 for coolant extending from the entrance end 2 to the opposite end 3 wherein there are passages 8 for removal of the coolant. The coolant passage 9 extends along the inner surface of the core 1 and between the inner walls of the ends 2, 3. A soft surface coating 10 is arranged on the outer surface of the core 1 and the coating 10 extends longitudinally over the area that is between the inner walls of the ends 2, 3 so that the entire area of soft coating is cooled.

The above described cooled roll is only one example of cooled soft rolls. Different kinds of cooled rolls are widely used in the art and the present invention is not limited to any specific construction of the roll.

Figure 2:
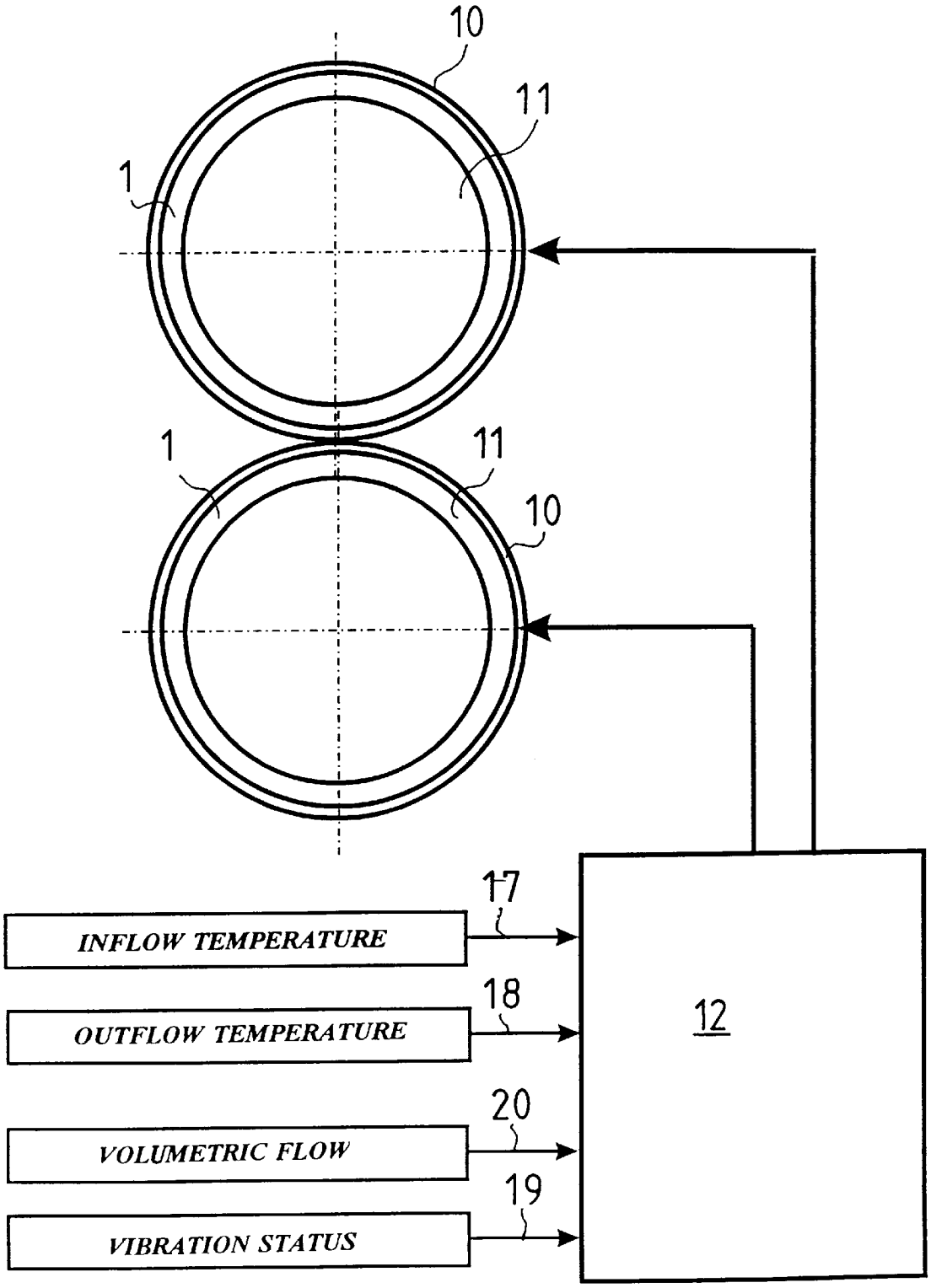
FIG. 2 is a diagram of a control system suitable for implementation of an embodiment of the present invention.

In FIG. 2 is schematically shown a control system which can be used for controlling the vibrations of a roll set. The roll set of FIG. 2 comprises two cooled soft rolls. A control apparatus 12 handles data obtained from various sources and controls the temperature of the cooling medium. Basically, the control apparatus governs the heat load which is transferred from the rolls to the coolant. For this reason, the temperature of the coolant entering the rolls is measured 17 as well as the temperature of the coolant leaving the rolls 18 and the volumetric flow 20. The cooling or heating power can be calculated from the temperature difference and the volumetric flow. The vibration of the roll set is also measured 19 and, when an increase of vibration is detected, the temperature of the entering coolant is appropriately changed.

Figure 3:
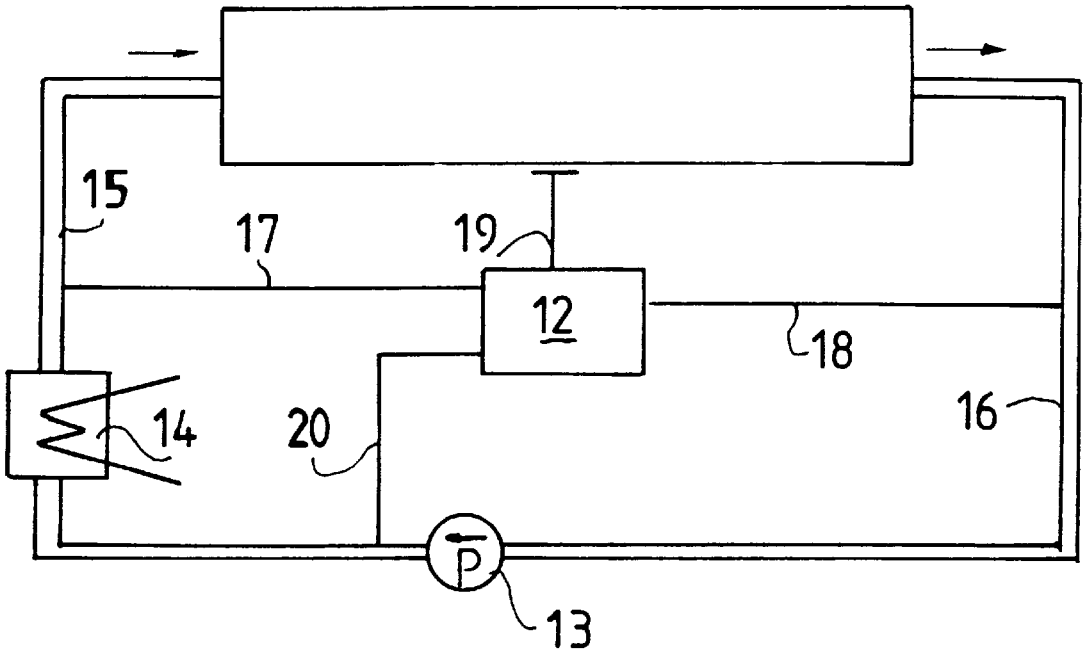
FIG. 3 is a diagram of a cooling/heating system suitable for implementation of the method.

FIG. 3 shows a closed circuit cooling system for implementation of the present invention. In modern paper mills the amount of waste water has to be kept to a minimum and therefore only closed cooling systems are acceptable. Of course, the present invention can, without difficulty, be accomplished by using an open cooling or heating system. In the system of FIG. 3 the coolant leaves the roll through an outflow duct 16 leading to a pump 13. The pump 13 feeds the coolant into a heat exchanger 14 wherefrom it flows through an inflow duct 15 into the roll. The temperature of inflowing and outflowing coolant is transmitted to the control apparatus 12 through measurement lines 17 and 18, respectively. The volumetric flow of the coolant is also detected and transmitted to the control apparatus 12 through line 20 and vibration data is transmitted to the control apparatus through line 19.

The natural frequency of the roll set can be changed either by cooling or heating at least one of the soft rolls. According to the present state of knowledge, cooling of the roll is preferred. In this embodiment, the vibration status of the roll set is measured and, when increasing amplitude or vibration energy is detected, the temperature of soft rolls, and especially their coating, is cooled by feeding more or colder coolant into the rolls. When the coating cools, its stiffness increases and the natural frequency of the roll set is changed. After a while the natural frequency no longer substantially coincides with the frequency of the excitements and increasing of the vibration energy stops and, if cooling is continued, begins to decrease. Alternatively, the temperature of the coating can be changed automatically at predetermined time intervals.

The development of vibrations in soft roll nips takes a long time, typically several hours and if the temperature of the soft coating is changed, for example, every operating hour, the system does not find its stable state and resonance does not occur. In this case, the temperature of the coating may also be increased, which can be implemented either by heating the coolant in the heat exchanger or simply by decreasing the cooling power so that the coating heats because of its repeated deformation and internal friction. In any case, the cooling or heating can be easily monitored by measuring the temperature of the outflowing coolant. The vibration status of the roll set can be monitored constantly and if the changing of the temperature of the roll coating is not sufficient to prevent the vibration, an alarm may be triggered. When an alarm is noticed, web speed may be changed or the machine may be stopped in a controlled manner.

Figure 4:
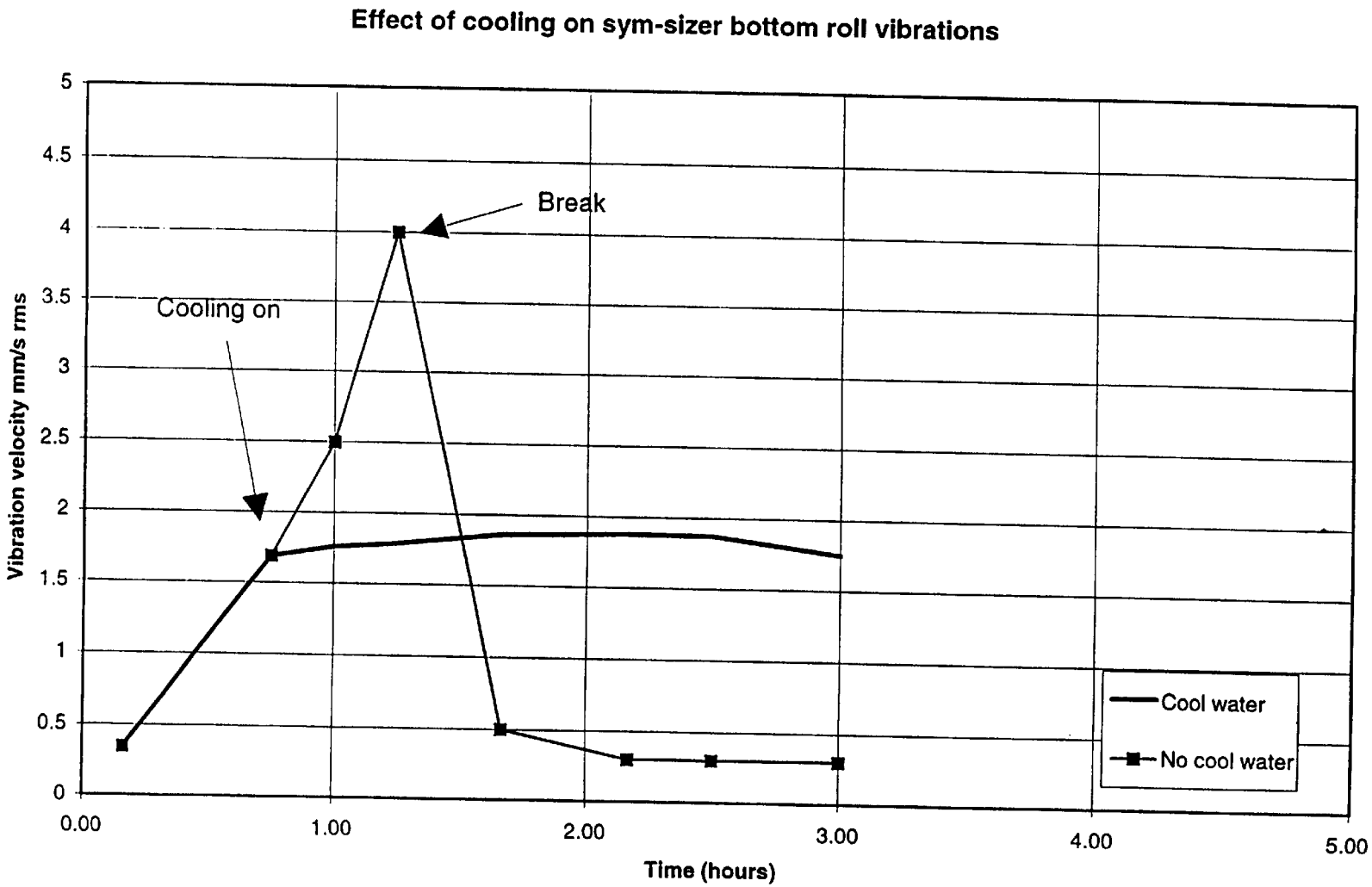
FIG. 4 is a chart of a vibration test done on an apparatus which was run according to the present invention.

FIG. 4 is a graph showing a test run which was done on a size press for examining the vibrations of the rolls set when the apparatus was run according to the present invention. The ordinate of the graph shows running time in hours and the abscissa shows vibration velocity of the bottom roll. The curve marked with square blocks shows an estimated development of the vibration when no control measures are taken, allowing the vibration to develop freely. In a resonance situation, the vibration velocity increases rapidly and if the web speed is not changed, increasing vibration leads to a web break and the machine must be stopped. When the machine was run according to the present invention, cooling was started when the vibration velocity was over 1.5 mm/s rms. Subsequently, the increasing of vibration slowed rapidly and when the cooling had been on for about two hours, began to slowly decrease. The test had to be stopped at three hours from starting but no web breaks occurred at the size press during the test. Similar behavior was observed also in confirmatory tests.

Thus, while there have been shown and described and pointed out fundamental novel features of the invention as applied to a preferred embodiment thereof, it will be understood that various omissions and substitutions and changes in the form and details of the apparatus may be made by those skilled in the art without departing from the spirit of the invention. For example, it is expressly intended that all combinations of those elements which perform substantially the same function in substantially the same way to achieve the same results are within the scope of the invention. Substitutions of the elements from one described embodiment to another are also fully intended and contemplated. It is also to be understood that the drawings are not necessarily drawn to scale but they are merely conceptual in nature. It is the intention, therefore, to be limited only as indicated by the scope of the claims appended hereto.

What is claimed is:

1. An apparatus for reducing vibrations of a roll set of a paper making apparatus, the roll set comprising at least two rolls at least one of which being a roll coated with a compressible coating, the apparatus comprising a means for changing a temperature of the coating of the at least one coated roll during operation of the apparatus so as to change the natural frequency of the roll set, wherein said means for changing the temperature of the coating of the at least one coated roll comprises:

means for supplying a fluid proximate the coating of the at least one coated roll;

means for removing fluid from proximate the coating of the at least one coated roll; and means for changing the temperature of the fluid supplied proximate the coating of the at least one coated roll.

2. The apparatus of claim 1, further comprising means for detecting a temperature of the fluid supplied proximate the coating of the at least one coated roll, and wherein said means for changing the temperature of the fluid changes the temperature of the fluid in response to the detected temperature of the fluid supplied proximate the coating of the at least one coated roll.

3. The apparatus of claim 2, further comprising means for detecting a temperature of the fluid removed from proximate the coating of the at least one coated roll, and wherein said means for changing the temperature of the fluid changes the temperature of the fluid in response to the detected temperature of the fluid removed from proximate the coating of the at least one coated roll.

4. The apparatus of claim 3, further comprising means for detecting the magnitude of vibration of the roll set and wherein said means for changing a temperature of the coating of the at least one coated roll changes the temperature of the coating of the at least one coated roll when the magnitude of vibration exceeds a predetermined value.

5. The apparatus of claim 4, wherein the paper making apparatus is a size press.

6. The apparatus of claim 4, wherein the paper making apparatus is a calender.

7. The apparatus of claim 2, further comprising means for detecting the magnitude of vibration of the roll set and wherein said means for changing a temperature of the coating of the at least one coated roll changes the temperature of the coating of the at least one coated roll when the magnitude of vibration exceeds a predetermined value.

8. The apparatus of claim 2, wherein the paper making apparatus is a size press.

9. The apparatus of claim 2, wherein the paper making apparatus is a calender.

10. The apparatus of claim 1, further comprising means for detecting a temperature of the fluid removed from proximate the coating of the at least one coated roll, and wherein said means for changing the temperature of the fluid changes the temperature of the fluid in response to the detected temperature of the fluid removed from proximate the coating of the at least one coated roll.

11. The apparatus of claim 10, further comprising means for detecting the magnitude of vibration of the roll set and wherein said means for changing a temperature of the coating of the at least one coated roll changes the temperature of the coating of the at least one coated roll when the magnitude of vibration exceeds a predetermined value.

12. The apparatus of claim 10, wherein the paper making apparatus is a size press.

13. The apparatus of claim 10, wherein the paper making apparatus is a calender.

14. The apparatus of claim 1, wherein the paper making apparatus is a size press.

15. The apparatus of claim 1, wherein the paper making apparatus is a calender.

16. An apparatus for reducing vibrations of a roll set of a paper making apparatus, the roll set comprising at least two rolls at least one of which being a roll coated with a compressible coating, the apparatus comprising a means for changing a temperature of the coating of the at least one coated roll during operation of the apparatus so as to change the natural frequency of the roll set, further comprising means for detecting the magnitude of vibration of the roll set and wherein said means for changing a temperature of the coating of the at least one coated roll changes the temperature of the coating of the at least one coated roll when the magnitude of vibration exceeds a predetermined value.

17. The apparatus of claim 16, wherein the paper making apparatus is a size press.

18. The apparatus of claim 10, wherein the paper making apparatus is a calender.

* * * * *